US005933864A

United States Patent [19]

Boykins

[11] Patent Number: 5,933,864

[45] Date of Patent: Aug. 10, 1999

[54] BODY SUIT

[76] Inventor: Terri L. Boykins, 3 Mayo St., Hurlbert Field, Fla. 32544

[21] Appl. No.: 09/102,187

[22] Filed: Jun. 22, 1998

[51] Int. Cl.[6] ..... A41D 1/06

[52] U.S. Cl. ..... 2/69; 2/79; 2/1

[58] Field of Search ..... 6/69, 79, 78.1, 6/80, 83, 114, 125, 126, 267, 159, 161.7, 164

[56] References Cited

U.S. PATENT DOCUMENTS

| | | | |
|---|---|---|---|
| 910,485 | 1/1909 | Baumann | 2/79 |
| 1,221,710 | 4/1917 | Earnshaw | 2/83 |
| 1,896,183 | 2/1933 | Manson | 2/79 |
| 2,130,771 | 9/1938 | Mann | 2/83 |
| 2,615,165 | 10/1952 | Steedman | 2/79 |
| 2,675,554 | 4/1954 | Gertz | 2/79 |
| 2,697,837 | 12/1954 | Goldman | 2/83 |
| 3,100,897 | 8/1963 | Langer | 2/79 |
| 3,221,342 | 12/1965 | Payne | 2/83 |
| 3,772,705 | 11/1973 | Angel et al. | 2/79 |
| 4,308,622 | 1/1982 | Maddron | 2/79 |

*Primary Examiner*—Gloria Hale
*Attorney, Agent, or Firm*—Peter Loffler

[57] ABSTRACT

A body suit for nighttime wearing by persons suffering from chronic skin ailments is comprised of a body garment. A first pair of sleeves is attached to the body garment, the first pair of sleeves each having a channel with an opening and a drawstring within the channel. A hand covering such as a glove or mitten having padding thereon is attached to each of the first pair of sleeves. A second pair of sleeves, each having an optional channel with an opening and a drawstring, is attached to the body garment. A footie may be attached to each of the second pair of sleeves and each of the second pair of sleeves may be impregnated with an anti-itch agent.

13 Claims, 4 Drawing Sheets

H
20
20
18
22
30
32
18
12
22
30
36
36
34
34
10
38
38
46
46

20
H
20
18
22
18
16
30
12
22
32
30
36
32
36
34
34
10
38
38
46
46

BODY SUIT

BACKGROUND OF THE INVENTION

1. Field of the Invention

The present invention relates to a body suit designed to prevent wearers from itching themselves while wearing the suit.

2. Background of the Prior Art

Children who suffer from chronic skin ailments, such as atopic dermitis and psoriasis, such ailments resulting in skin lesions and eruptions, tend to exacerbate their condition by itching themselves about the affected area. This itching is especially acute during the nighttime hours when the children are in bed. Oftentimes, the children will remain awake throughout the night due to the constant itching of the affected area. While drug therapies are available to relieve the symptoms of these ailments, the therapies do not completely alleviate the itching problem. Lotions, such as coal tar creams, BENADRYL, an antihistamine WESTCORT, a corticosteroid chortisone, CORTAID, a corticosteroid corticosteroids, AQUAPHOR, a healing ointment, and EYCERINE, a moisturizing cream are available to be placed onto the affected area, they too are not a complete solution to the itch problem. Many children will continue to itch throughout the night with the itching prolonging the duration of the lesions and eruptions despite the drug and lotion therapies.

Therefore, there is a need in the art for a device that will alleviate the itching problem acquired by sufferers of various chronic skin ailments. Such a device must reduce or outright prevent the ability of a user to itch himself and thereby allow the condition to better itself over time. Such a device must be a complement to any drug or lotion therapies being undergone by the user of the device. The device must be of relatively simple and straightforward design and construction and must be relatively safe and easy to use.

SUMMARY OF THE INVENTION

The body suit of the present invention addresses the aforementioned needs in the art. The present invention provides for a body suit to be nocturnally worn by a user, with the body suit preventing the user from itching himself and thereby exacerbating his condition.

The body suit is comprised of a body garment tailored and fashioned for either a male or a female. An opening is provided on the front, the back, or both with appropriate closures provided thereat. A first pair of sleeves is provided each having a first end attached to the body garment, a second end, a first outer surface, a first inner surface, and a first channel with a first opening. A first pair of drawstrings, which may be elasticized, is provided with each disposed within a respective one of the first channel and accessed through the first opening. A pair of hand coverings such as mittens or gloves is provided with each attached to a respective one of the second end. Each mitten or glove has an upper surface and a lower surface with padding attached to the lower surface.

A second pair a sleeves is provided each having a third end attached to the body garment, a fourth end, a second outer surface, a second inner surface, and an optional second channel with a second opening. A second pair of drawstrings, which may be elasticized, is provided with each disposed within a respective one of the second channel and accessed through the second opening. A pair of footies may be provided with each attached a respective one of the fourth end. The inner surface of the second end may be impregnated with an anti-itch agent selected from the group consisting of coal tar creams, BENADRYL, an antihistamine WESTCORT, a corticosteroid chortisone, CORTAID, a corticosteroid corticosteroids, AQUAPHOR, a healing ointment and EYCERINE, a moisturizing cream.

A user dons the body garment such that his arms are received within the first pair of sleeves and his legs are received within the second pair of sleeves. Each of the first drawstrings is sufficiently tightened so as to prevent the user from withdrawing his arms from the first pair of sleeves but not so much as to cause discomfort or injury. Each of the second drawstrings, if used, is sufficiently tightened so as to prevent the user from withdrawing his legs from the second pair of sleeves as well as from inserting his hands thereinto, but not so much as to cause discomfort or injury.

The user can now go to sleep without the ability to scratch himself to the point of malady exacerbation. The padded mittens or gloves prevent all but a dull scratching of the user's body within the body suit and the first pair of drawstrings, prevent the user from withdrawing his arms from the first pair of sleeves and directly accessing other body parts with his bare fingers. The anti-itch agent impregnated within the second set of sleeves further help prevent the need to itch and is a complement to any drug or lotion therapy of the user.

BRIEF DESCRIPTION OF THE DRAWINGS

Similar reference numerals refer to similar parts throughout the several views of the drawings.

DESCRIPTION OF THE PREFERRED EMBODIMENT

Figure 1:
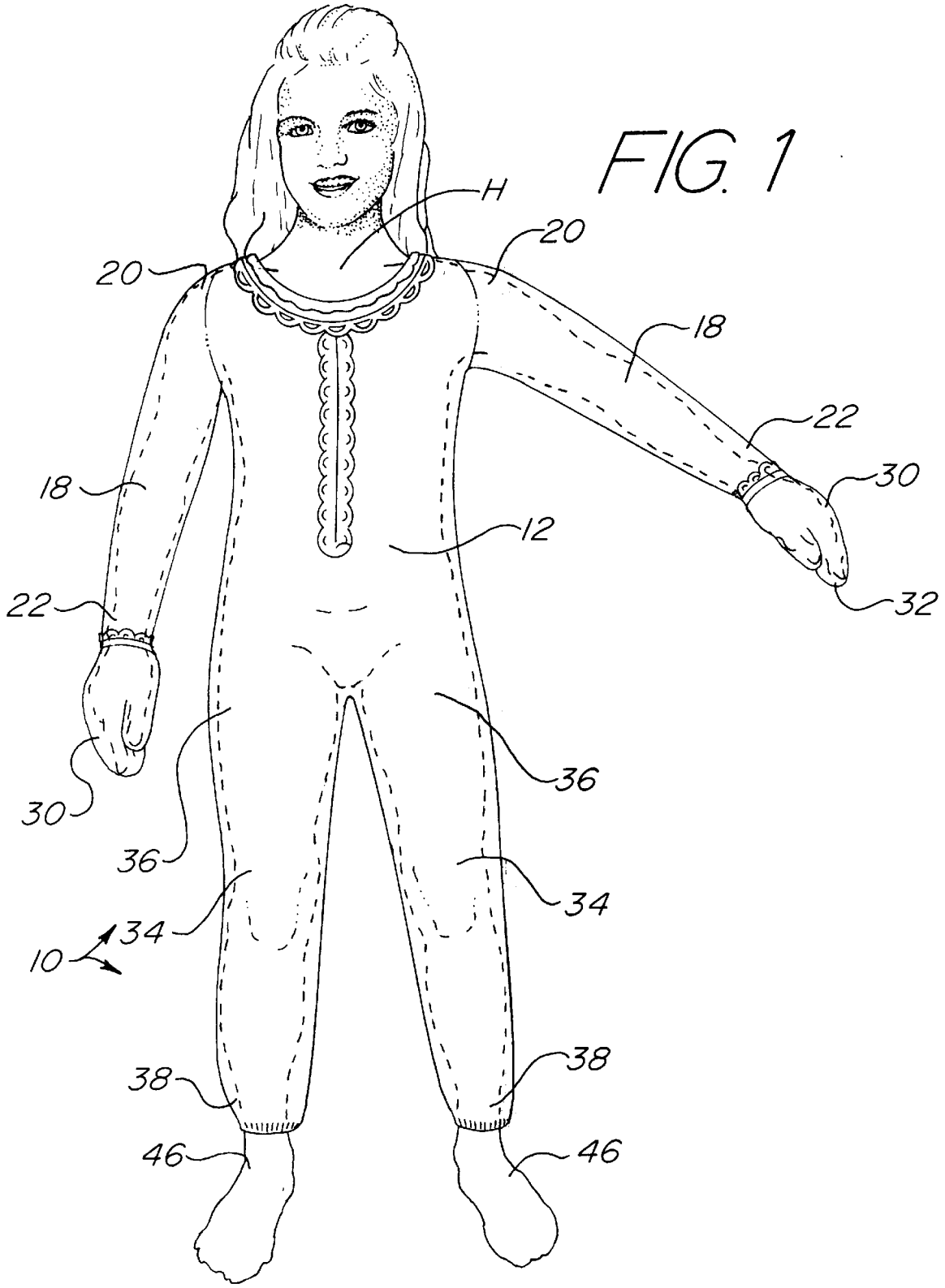
FIG. 1 is a perspective view of the body suit of the present invention tailored for wearing by a female.
Figure 2:
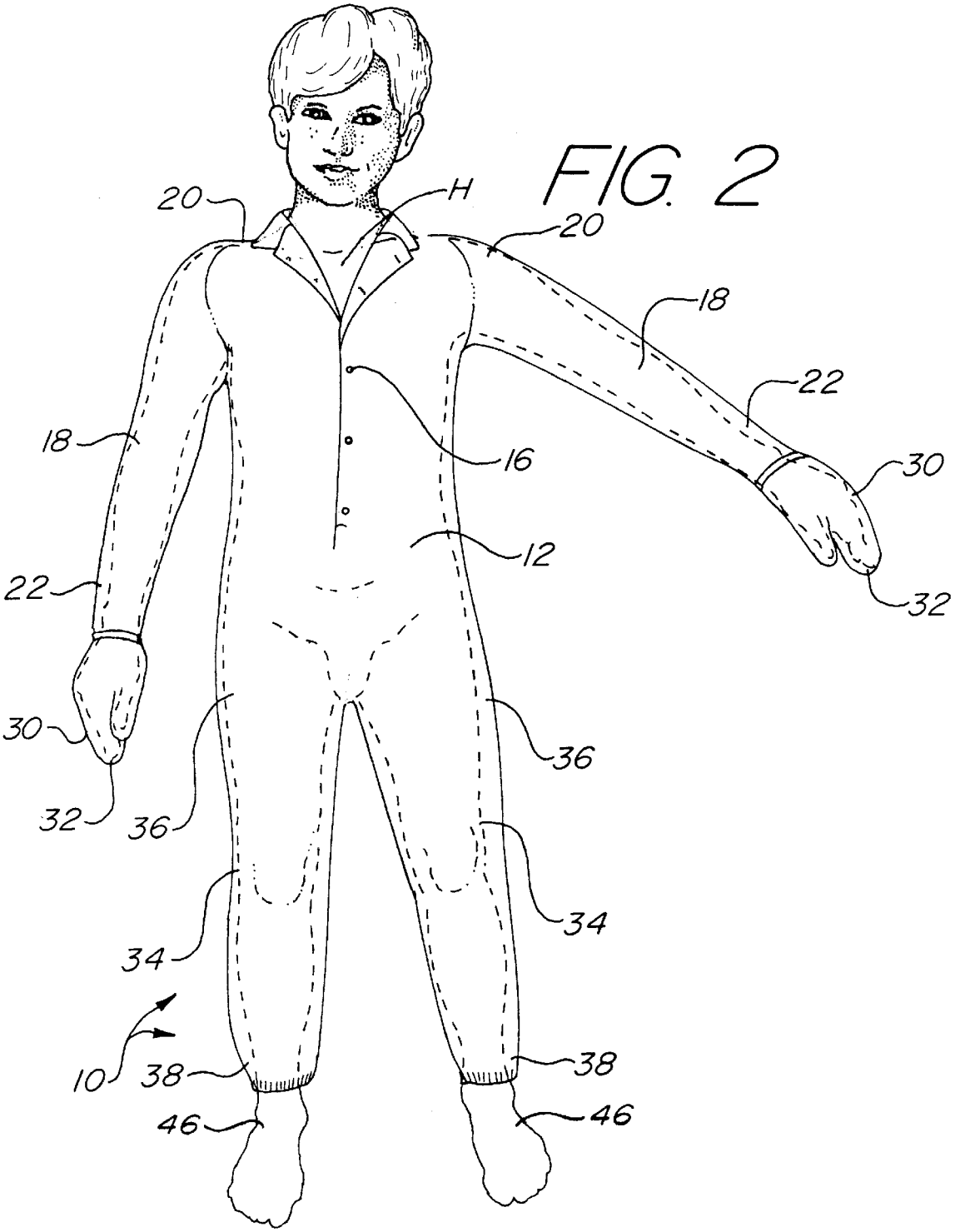
FIG. 2 is a perspective view of the body suit of the present invention tailored for wearing by a male.
Figure 3:
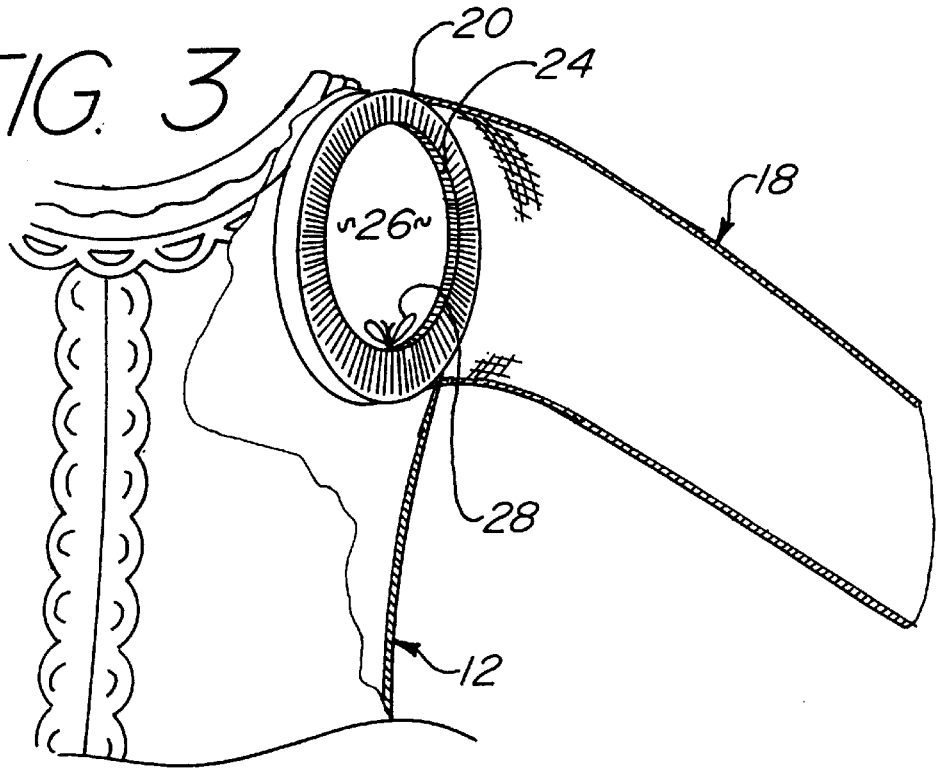
FIG. 3 is a close-up view, partially sectioned, of one of the first pair of sleeves of the body suit.
Figure 4:
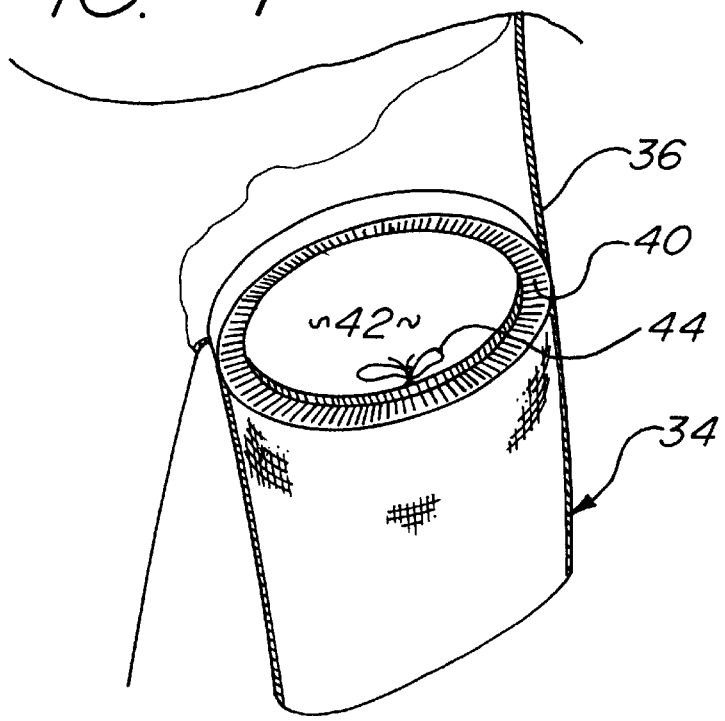
FIG. 4 is a close-up view, partially sectioned, of one of the second pair of sleeves of the body suit.
Figure 5:
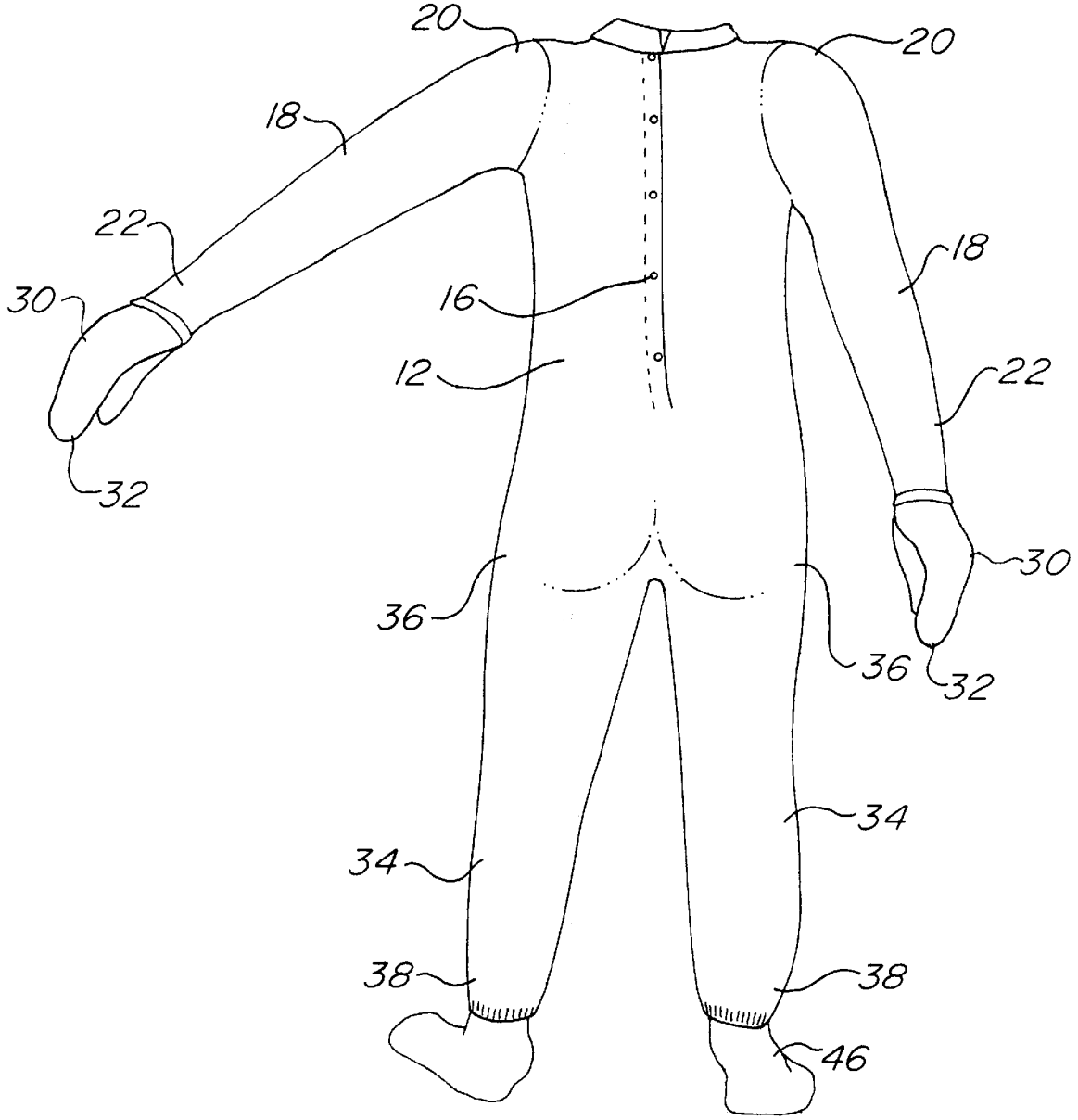
FIG. 5 is a rear perspective view of the body suit.

Referring now to the drawings, it is seen that the body suit of the present invention, generally denoted by reference numeral 10, is comprised of a body garment 12 which can be tailored and fashioned for wearing by a female (as illustrated in FIG. 1) or by a male (as illustrated in FIG. 2). The body garment 12 will have appropriate openings 14 located on the front of the body garment 12, the back, or both. Appropriate closures, such as the illustrated buttons 16, snaps, zippers, and the like can be operatively associated with each opening.

A first pair of sleeves 18 is provided, each having a first end 20 and a second end 22 such that each first end 20 is attached to the body garment 12. Each of the first pair of sleeves 18 has an inner surface and an outer surface and a first channel 24 with a first opening 26. A first drawstring 28, which may be elasticized, is disposed within each of the first channels 24. Each first channel 24 can be located anywhere along the length of its respective first sleeve 18, although will be, advantageously, located proximate the first end 20. Each of the first openings 26 can be located on either the outer surface, the inner surface, or both and provides access to the first drawstring 28 disposed within the first channel 24. A hand covering such as a mitten 30 (illustrated) or a glove (not illustrated) is attached to each of the second ends 22 of the first sleeve 18. Each mitten 30 or glove has an upper surface and a lower surface with padding 32 thereon.

A second pair of sleeves 34 is provided, each having a third end 36 and a fourth end 38 such that each third end 36 is attached to the body garment 12. Each of the second pair of sleeves 34 has an inner surface and an outer surface and may have a second channel 40 with a second opening 42. A second drawstring 44, which may be elasticized, is disposed within each of the second channels 40. Each second channel 40 can be located anywhere along the length of its respective second sleeve 34. Each of the second openings 42 can be located on either the outer surface, the inner surface, or both of the second sleeve 34 and provides access to the second drawstring 44 disposed within the second channel 40. A footie 46 may be attached to each of the fourth ends 38 of the second sleeve 34. Each footie 46 may be padded for user comfort. If desired, each of the second pair of sleeves 34 may be impregnated with an anti-itch agent, the anti-itch agent being selected from the group consisting of coal tar creams, BENADRYL, an antihistamine WESTCORT, a corticosteroid chortisone, CORTAID, a corticosteroid corticosteroids, AQUAPHOR, a healing ointment and EYCERINE, a moisturizing cream.

In order to use the body suit 10 of the present invention, the user places the body garment onto himself such that his arms are received within the first set of sleeves 18 and his legs are received within the second set of sleeves 34. The user's hands are received within the mittens 30 or gloves and his feet are received within the footies 46, if used. The first pair of drawstrings 28 is tightened an appropriate amount to prevent the user from withdrawing his arms from the first pair of sleeves 18, although not too much to prevent discomfort or harm to the user. The second pair of drawstrings 44, if used, is tightened an appropriate amount to prevent the user from withdrawing his legs from the first second of sleeves and from inserting his hands thereinto, although not too much to prevent discomfort or harm to the user. The closures on the front and/or back of the body garment 12 are adjusted as desired, and the user is free to wear the body suit 10 to sleep.

While the invention has been particularly shown and described with reference to an embodiment thereof, it will be appreciated by those skilled in the art that various changes in form and detail may be made without departing from the spirit and scope of the invention.

I claim:

1. A body suit comprising:

body garment;

a first pair of sleeves, each having a first end attached to the body garment, a second end, a first inner surface, a first outer surface, and a first channel with a first opening;

a first pair of hand coverings, each having an upper surface and a lower surface and attached to a respective one of the second end;

a first pair of padding elements, each attached to a respective one of the lower surface;

a first pair of drawstrings, each disposed within a respective one of the first pair of channels; and a second pair of sleeves, each having a third end attached to the body garment, a fourth end, a second inner surface, and a second outer surface.

2. The body suit as in claim 1 wherein each of the first pair of openings is located on the first inner surface.

3. The body suit as in claim 1 wherein each of the first pair of openings is located on the first outer surface.

4. The body suit as in claim 1 wherein each of the first pair of drawstrings is elasticized.

5. The body suit as in claim 1 wherein each of the hand coverings is a mitten.

6. The body suit as in claim 1 wherein each of the hand coverings is a glove.

7. The body suit as in claim 1 further comprising:

a second pair of channels, each having a second opening and disposed within a respective one of the second pair of sleeves; and a second pair of drawstrings, each disposed within a respective one of the second pair of channels.

8. The body suit as in claim 7 wherein each of the second pair of openings is located on the second inner surface.

9. The body suit as in claim 7 wherein each of the second pair of openings is located on the second outer surface.

10. The body suit as in claim 7 wherein each of the second pair of drawstrings is elasticized.

11. The body suit as in claim 1 further comprising a pair of footies, each attached to a respective one of the fourth end.

12. The body suit as in claim 1 wherein each of the second pair of sleeves is impregnated with an anti-itch agent.

13. The body suit as in claim 12 wherein the anti-itch agent is selected from the group consisting of coal tar creams, chortisone, corticosteroids, an antihistamine, a healing ointment, and a moisturizing cream.

* * * * *